US009975367B2

(12) United States Patent
Koide

(10) Patent No.: US 9,975,367 B2
(45) Date of Patent: May 22, 2018

(54) REVERSE TYPE STAMP

(71) Applicant: SHACHIHATA INC., Nagoya-Shi (JP)

(72) Inventor: Takuya Koide, Nagoya (JP)

(73) Assignee: Shachihata Inc., Nagoya-Shi (JP)

( * ) Notice: Subject to any disclaimer, the term of this patent is extended or adjusted under 35 U.S.C. 154(b) by 0 days. days.

(21) Appl. No.: 15/451,903

(22) Filed: Mar. 7, 2017

(65) Prior Publication Data

US 2017/0274692 A1 Sep. 28, 2017

(30) Foreign Application Priority Data

Mar. 23, 2016 (JP) ..... 2016-057795
Dec. 26, 2016 (JP) ..... 2016-252140

(51) Int. Cl.

| | |
|---|---|
| ***B41K 1/02*** | (2006.01) |
| ***B41K 1/40*** | (2006.01) |
| ***B41K 1/22*** | (2006.01) |
| ***B41K 1/04*** | (2006.01) |
| *B41K 3/56* | (2006.01) |

(52) U.S. Cl.

CPC ..... *B41K 1/22* (2013.01); *B41K 1/02* (2013.01); *B41K 1/04* (2013.01); *B41K 1/40* (2013.01); *B41K 3/56* (2013.01)

(58) Field of Classification Search

CPC ... B41K 1/02; B41K 1/36; B41K 1/38; B41K 1/40; B41K 1/42; B41K 1/54; B41K 1/58; B41K 3/56

USPC ..... 101/334, 104

See application file for complete search history.

(56) References Cited

U.S. PATENT DOCUMENTS

| | | | | |
|---|---|---|---|---|
| 5,261,325 A * | 11/1993 | Bengtsson | ..... | B41K 1/50 101/327 |
| 8,783,176 B2 * | 7/2014 | Cziraky | ..... | B41K 1/54 101/333 |
| 2006/0162596 A1 | 7/2006 | Faber | | |
| 2010/0326299 A1 | 12/2010 | Kamiyama et al. | | |

FOREIGN PATENT DOCUMENTS

| | | |
|---|---|---|
| EP | 2 266 809 A1 | 12/2010 |
| JP | 49-037727 A1 | 4/1974 |
| JP | 2011-025659 A1 | 2/2011 |

OTHER PUBLICATIONS

Partial European Search Report (Application No. 17160623.9) dated Aug. 7, 2017.

* cited by examiner

*Primary Examiner* — Leslie J Evanisko
(74) *Attorney, Agent, or Firm* — Burr & Brown, PLLC

(57) ABSTRACT

A reverse type stamp includes an outer cylindrical body, an inner cylindrical body which is movable relative to the outer cylindrical body, an elastic member that constantly urges the inner cylindrical body in a protruding direction inside the outer cylindrical body, an inversion body which is reversed and returned in synchronization with the relative movement, and a print body which is joined to the inversion body. When the outer cylindrical body is pressed down while the inner cylindrical body stands on a paper surface, the inversion body is reversed inside the inner cylindrical body for an imprinting operation. An ink pad is provided inside a movable container inside a cartridge. The movable container is elastically supported inside the cartridge by a coil spring provided at a rear surface thereof. Since contact between the ink pad and the print body is buffered, the sagging of the ink pad can be prevented.

8 Claims, 7 Drawing Sheets

REVERSE TYPE STAMP

BACKGROUND OF THE INVENTION

1. Field of the Invention

The present invention relates to a reverse type stamp which performs an imprinting operation by reversing a print body.

2. Description of the Related Art

Conventionally, a reverse type stamp is known in which an ink pad is brought into contact with a stamp surface of a print body to supply ink thereto and the stamp surface is reversed downward while a grip is pressed to perform an imprinting operation (for example, see JP 2011-25659 A). Particularly when quick-drying ink is used in this kind of stamp, it is necessary to enhance the air-tightness of the ink pad in order to prevent volatilization and drying of the ink. For example, JP 49-37727 A discloses a technology of preventing ink from being quickly dried by pressing a side wall of a print body against the periphery of an ink pad when a stamp is not used.

When quick-drying ink is used, it is necessary to ensure the air-tightness of the ink pad even when a variation or error in dimension occurs in a molded article or a print body. For this reason, when a highly repellent spring is used and a stamp surface having an unevenness contacts the ink pad for a long period of time, the ink pad may be sagged. In that case, when a transfer position is slightly displaced, ink of the sagged pad does not adhere to the print body. As a result, since an unevenness may occur in the ink adhesion amount on the stamp surface, quality deterioration such as imprint spots may occur. Further, since a transfer load of the stamp surface in accordance with a dimensional change (variation) of a molded article may be unnecessarily increased, quality deterioration such as imprint blur may occur due to an increase in ink adhesion amount of the stamp surface.

SUMMARY OF THE INVENTION

An advantage of some aspects of the invention is to provide a reverse type stamp capable of preventing an ink pad from being sagged due to a contact with a stamp surface and a transfer load from being unnecessarily increased in accordance with a dimensional change of a molded article or the like while ensuring the air-tightness of the ink pad even when a variation in dimension occurs in a molded article (a stamp surface) or a print body.

According to an aspect of the invention, there is provided A reverse type stamp comprising an outer cylindrical body; an inner cylindrical body which is accommodated in the outer cylindrical body and configured to be able to perform a relative movement thereto; an elastic member which constantly urges the inner cylindrical body in a protruding direction inside the outer cylindrical body; an inversion body which is accommodated in the inner cylindrical body and configured to be able to be reversed and returned in synchronization with said relative movement; and a print body which is joined to the inversion body, wherein the inner cylindrical body slidably accommodates a movable container with an ink pad, and the movable container is elastically supported by an urging means, which applies an elastic force to a surface of the movable container opposite to a stamp surface of the print body.

In the reverse type stamp with this configuration, the movable container may be accommodated inside an accommodation space of the inner cylindrical body, the accommodation space may be blocked by the print body using a repelling force of the elastic member, and a sealing member may be provided for air-tightness of the accommodation space blocked by the print body.

In the reverse type stamp with this configuration, the sealing member may be an O-ring which surrounds an outer peripheral portion of the print body.

In the reverse type stamp with this configuration, an elastic modulus of the urging means may be set to be smaller than that of the ink pad.

In the reverse type stamp with this configuration, the urging means may be a coil spring which is provided at a rear surface of the movable container.

Further, according to another aspect of the invention, there is provided a reverse type stamp comprising an outer cylindrical body, an inner cylindrical body which is accommodated in the outer cylindrical body and configured to be able to perform a relative movement thereto, an elastic member which constantly urges the inner cylindrical body in a protruding direction inside the outer cylindrical body, an inversion body which is accommodated in the inner cylindrical body and configured to be able to be reversed and returned in synchronization with said relative movement, and a print body which is joined to the inversion body, wherein the inner cylindrical body has an ink cartridge therein, and wherein an inner portion of the ink cartridge is sealed by a sealing member provided at the inversion body and a sealed surface of the ink cartridge receiving the sealing member is formed in a tapered shape.

In the reverse type stamp with this configuration, the sealing member may be an O-ring suitable for the print body and the sealed surface may be formed as an inclined surface which decreases in diameter as it goes toward a center.

In the reverse type stamp with this configuration, the sealed surface may be provided with a second inclined surface which is formed at the outside of a first inclined surface to have an inclination angle different from that of the first inclined surface.

According to the reverse type stamp of the invention, since the movable container is elastically supported, a contact between the ink pad and the stamp surface is buffered. Thus, it is possible to prevent the ink pad from being sagged and to prevent the transfer load from being unnecessarily increased in accordance with the dimensional change of the molded article (the stamp surface). Accordingly, it is possible to prevent the spot and the blur of the seal imprint.

Further, according to the reverse type stamp of the invention, the inside of the ink cartridge is sealed through the sealing member provided at the inversion body used for joining the print body. In this configuration, since the sealed surface of the ink cartridge receiving the sealing member is formed in a tapered shape, it is possible to realize the air-tightness of the ink cartridge by a force smaller than that of the conventional configuration in which the sealing member is received by the flat surface. Since the air-tightness of the ink pad is sufficiently ensured and a large urging force for improving the sealability of the ink cartridge is not needed, a force (a force against the urging force of the elastic member) for the imprinting operation may be small.

DETAILED DESCRIPTION OF THE PREFERRED EMBODIMENTS

Figure 1:
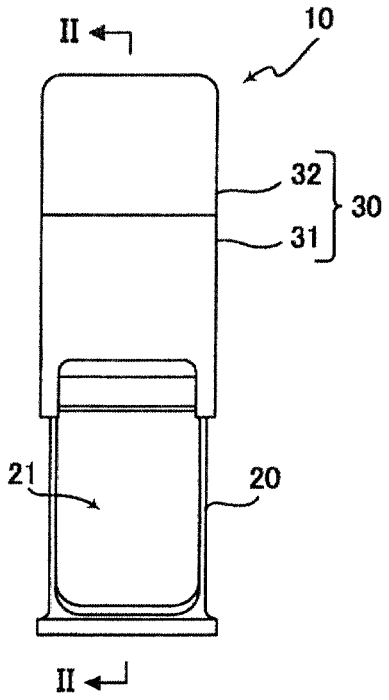
FIG. 1(*a*) is a front view of a reverse type stamp according to an embodiment of the invention a, FIG. 1(*b*) is a side view of the same.
Figure 1:
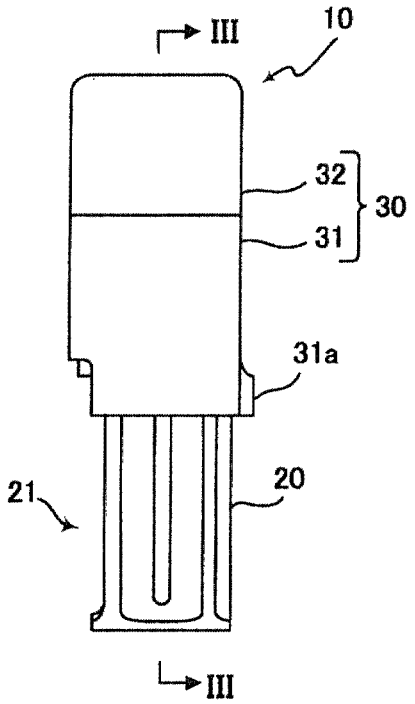
Figure 2:
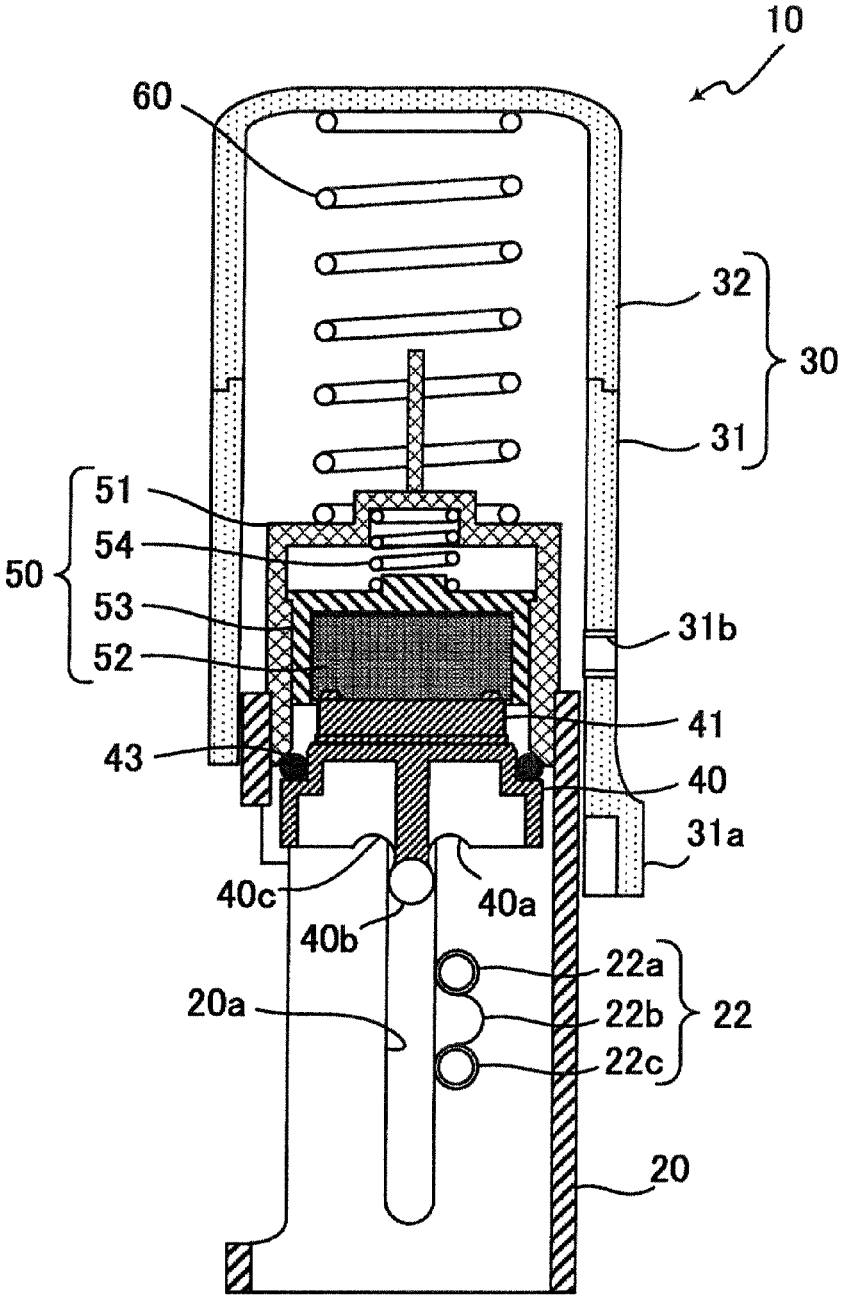
FIG. 2 is a cross-sectional view of the reverse type stamp illustrated in FIG. 1(*a*), taken along a line II-II thereof.
Figure 3:
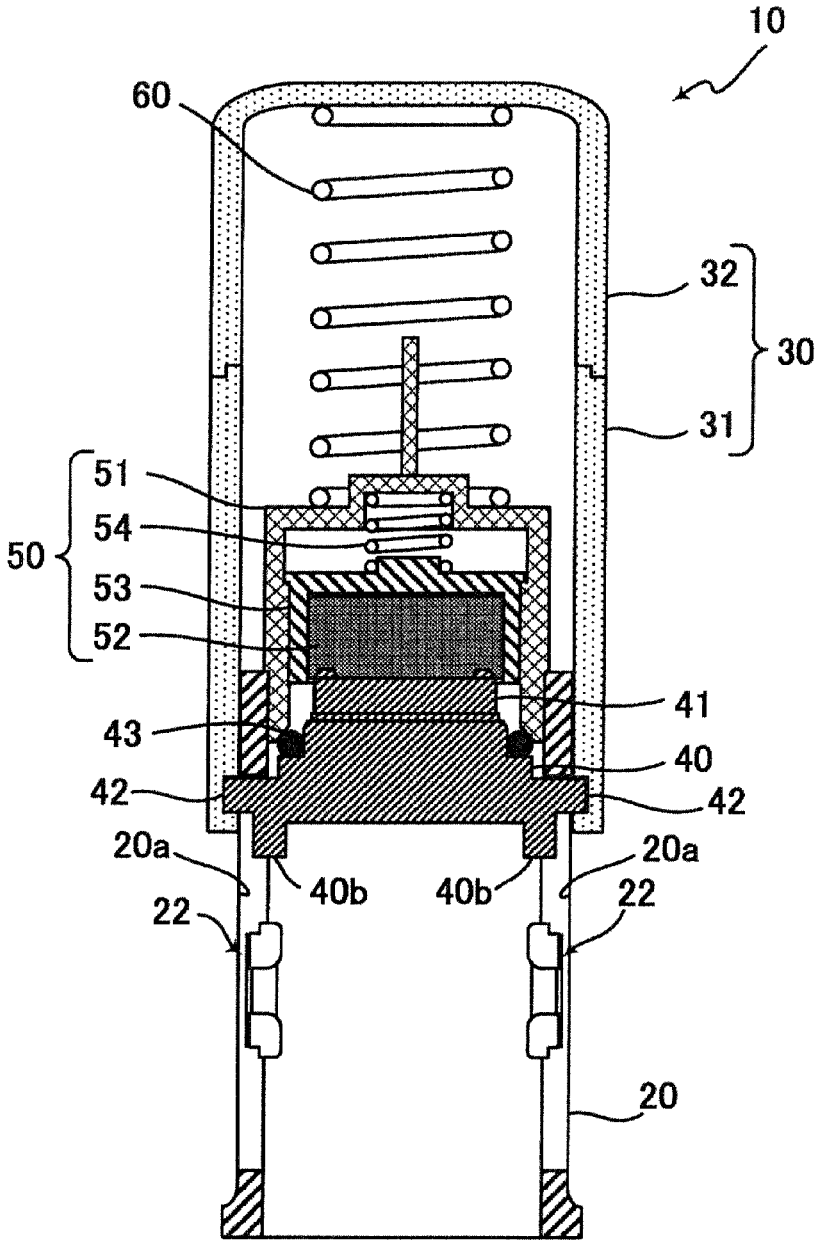
FIG. 3 is a cross-sectional view of the reverse type stamp illustrated in FIG. 1(*b*), taken along a line III-III thereof.

Hereinafter, a configuration of a reverse type stamp 10 according to a preferred embodiment of the invention will be described with reference to the drawings. FIG. 1(*a*) is a front view of the reverse type stamp 10 and FIG. 1(*b*) is a side view of the reverse type stamp 10. FIG. 2 is a cross-sectional view of the reverse type stamp illustrated in FIG. 1(*a*), taken along a line II-II thereof and FIG. 3 is a cross-sectional view of the reverse type stamp illustrated in FIG. 1(*b*), taken along a line III-III thereof.

The reverse type stamp 10 includes an outer cylindrical body 30, an inner cylindrical body 20 which is fitted to the outer cylindrical body 30 to be relatively movable to each other, a coil spring 60 which is a first elastic member constantly urging the inner cylindrical body 20 in a protruding direction inside the outer cylindrical body 30, an inversion body 40 which is configured to be able to be reversed and returned in synchronization with the sliding motion between the outer cylindrical body 30 and the inner cylindrical body 20, and a print body 41 which is joined to one surface of the inversion body 40 by adhering or the like. A stamp surface of the print body 41 according to the embodiment is circular and the outer cylindrical body 30 and the inner cylindrical body 20 are substantially cylindrical in conformity with the print body 41 and the like. The outer cylindrical body 30 is a container accommodating an ink cartridge 50, the inner cylindrical body 20, and a print body 41 (these will be described below), and is also a member which functions as a handle portion (grip) in the stamping using the reverse type stamp 10. Further, in order to facilitate the attachment/detachment of the coil spring 60 and the replacement of the ink cartridge 50, the outer cylindrical body 30 is configured by two members, that is, a cylindrical portion 31 and a cap portion 32 attachable to and detachable from the cylindrical portion 31. The cap portion 32 can be installed removably to the cylindrical portion 31 by an appropriate means such as a fitting or locking mechanism in order to block the upper portion of the cylindrical portion 31.

A protrusion 31*a* for preventing the rolling of the cylindrical stamp 10 may be formed, for example, at the rear side of the outer wall of the cylindrical portion 31. Further, the protrusion 31*a* can be used as a mark indicating the direction of the stamp 10 during the imprinting operation. In the embodiment, the protrusion 31*a* is formed so as to be located at the lower side of a seal imprint after the seal imprint is transferred to a paper surface. In other words, since the stamping operation is performed so that the protrusion 31*a* of the stamp 10 is located on a user side, the seal imprint can be correctly aligned in the up/down direction.

A window hole 31*b* for confirming whether the ink cartridge 50 is properly inserted into a predetermined position at the back may be provided in a part of the cylindrical portion 31 of the outer cylindrical body 30.

The inner cylindrical body 20 is a substantially cylindrical hollow member having an opening portion 21 on the side (front side) on which the stamp surface of the print body 41 rotates. The ink cartridge 50 is fitted into the inner cylindrical body 20. The outer diameter of the inner cylindrical body 20 corresponds to the inner diameter of the outer cylindrical body 30 and the upper portion of the inner cylindrical body 20 is inserted into the lower opening portion of the outer cylindrical body 30 so as to be relatively movable.

Figure 4:
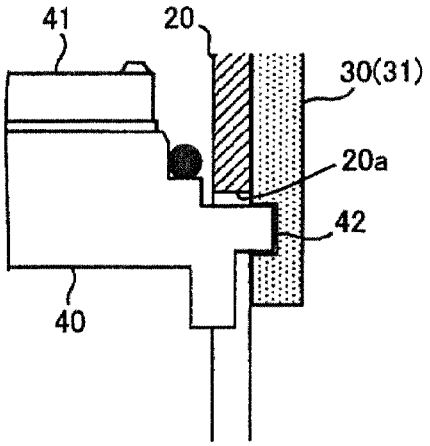
FIG. 4(*a*) and FIG. 4(*b*) are diagrams illustrating a structure supporting a print body.
Figure 4:
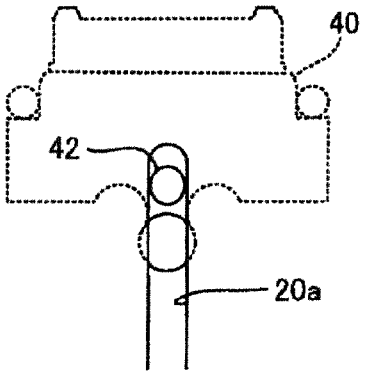

Slit apertures 20*a* and 20*a* having elongated shapes in the up/down direction corresponding to the sliding direction of the inner cylindrical body 20 are formed at both left and right sides of the inner cylindrical body 20. Through the slit apertures 20*a* and 20*a* inserted are horizontal shafts 42 and 42 of the inversion body 40 which are supported rotatably by the inner wall portion of the outer cylindrical body 30. That is, as illustrated in FIG. 4, the up/down movement of the inversion body 40 (here, a stroke range is limited by the length of the slit aperture 20*a*) in synchronization with the pressing operation of the outer cylindrical body 30 and the rotation of the inversion body 40 about the horizontal shaft 42 passing through the slit aperture 20*a* are allowed inside the inner cylindrical body 20.

The outer cylindrical body 30 accommodates the inner cylindrical body 20 so that the inner cylindrical body is relatively movable through the coil spring 60 which is a first elastic member. The compressed coil spring 60 comes into contact with the upper portion (an outer frame case 51) of the ink cartridge 50 fitted to the inner cylindrical body 20 and constantly urges the inner cylindrical body 20 toward the inversion body 40. During no usage of the stamp 10, the inner cylindrical body 20 is kept at the position where the inner cylindrical body protrudes most from the outer cylindrical body 30. At this time, an O-ring 43, as a sealing member, provided at the inversion body 40 comes into press-contact with an end inner wall (more specifically, a sealed surface formed at the opening end of the outer frame case 51) of the ink cartridge 50. Accordingly, since the ink cartridge 50 is blocked, drying of an ink pad 52 therein is prevented.

Further, the inner wall portion of the inner cylindrical body 20 is provided with an inversion guide 22 which inverts the inversion body 40 joined to the print body 41 along the slit aperture 20*a*. The inversion guide 22 of the embodiment is formed so that a substantially semi-circular intermediate groove 22*b* is formed between two small columnar protrusions 22*a* and 22*c*. Here, the inversion guide is not limited to the example described herein as long as the inversion guide is a gear body or a cam mechanism which meshes with the inversion body 40 to invert the inversion body in accordance with the up/down movement of the inversion body 40.

As described above, the ink cartridge 50 for supplying ink to the print body 41 is configured to be inserted into the upper portion of the inner cylindrical body 20. That is, the ink cartridge 50 is detachably held inside the inner cylindrical body 20. The ink cartridge 50 has a configuration in which a movable container 53 having the ink pad 52 built therein is slidable up and down inside the accommodation space of the outer frame case 51. The moving direction of the movable container 53 inside the ink cartridge 50 matches the sliding direction of the inner cylindrical body 20 inside the outer cylindrical body 30.

In the ink cartridge 50, the movable container 53 which accommodates the ink pad 52 is elastically supported by a coil spring 54 which is a second elastic member inside the outer frame case 51. The coil spring 54 which is an urging means constantly applies an elastic force to the rear surface (the upper surface) of the movable container 53 in a compressed state so that the movable container 53 is constantly urged toward the print body 41. In a case where a relatively hard ink pad 52 is adopted, it is desirable that the elastic modulus (spring constant) of the coil spring 54 be smaller than that of the ink pad 52.

The ink to be impregnated into the ink pad 52 can be appropriately used regardless of pigment type, dye type, oil type, and aqueous type. For example, as quick-drying ink for imprinting on hard-absorbent paper such as coated paper, plastic film, aluminum, and iron or non-absorbent material, oil-based ink obtained by dissolving and mixing a coloring agent in quick-drying solvent can be used.

In the embodiment, as the material of the ink pad 52, a polyolefin type fiber made of polyethylene (PE) and polypropylene (PP) was used. In addition, the ink pad 52 has a two-layer structure with different basis weight (fiber density) since the continuous sealability is better than that of a single layer ink pad. For example, the basis weight on the substrate side can be set to 0.15 g/cm$^3$ with respect to the basis weight of 0.23 g/cm$^3$ on the surface layer side being in contact with the stamp surface.

In this way, when the fiber density on the surface layer side is higher than that of the substrate side, it is possible to create a flow of ink from the substrate side to the surface layer side due to a difference in capillary force. As a result, it is possible to stably shorten the transfer time of the ink to the print body 41 and to improve the continuous sealability.

Figure 5:
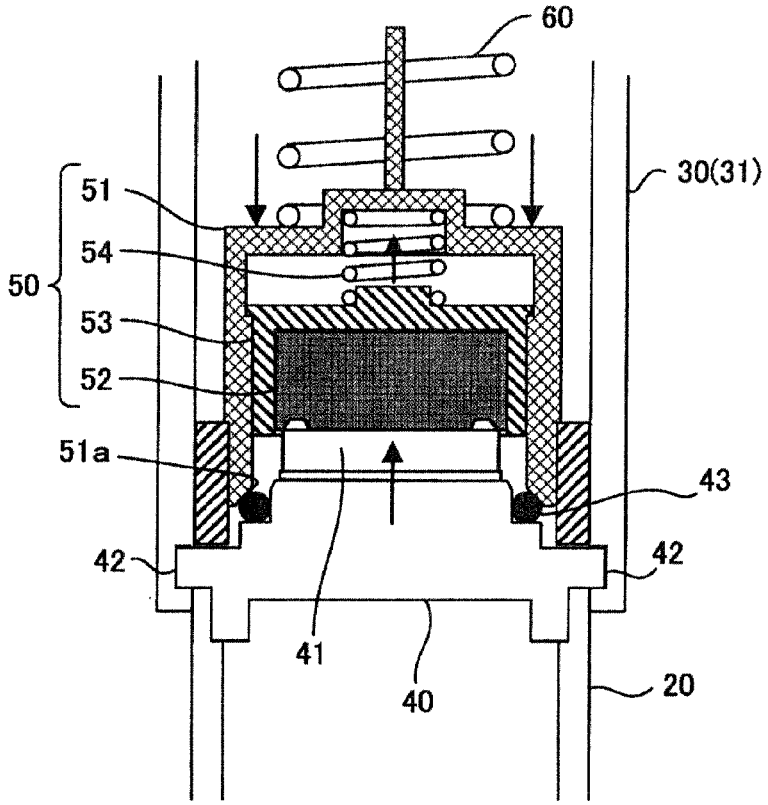
FIG. 5 is a diagram illustrating a structure of a print body and an ink cartridge.

During no usage of the stamp 10, the outer cylindrical body 30 is located at the upper side where the outer cylindrical body is not pressed and the lower surface of the ink pad 52 contacts the upper surface of the print body 41 as in FIG. 5. In the related art, when the print body 41 having an unevenness formed on a stamp surface is disposed to contact the ink pad 52 for a long period of time, there is a concern that plastic deformation or sagging occurs in the ink pad 52. However, in the embodiment, since the movable container 53 having the ink pad 52 is elastically supported through the coil spring 54 having an elastic modulus smaller than that of the ink pad 52, the transfer load of the print body 41 with respect to the ink pad 52 is reduced. Thus, a deformation such as sagging of the ink pad 52 can be prevented.

Further, as illustrated in FIG. 5, the ink cartridge 50 is blocked by the inversion body 40 urged by the coil spring 60. More specifically, a sealed surface 51*a* of the end inner wall of the ink cartridge 50 receiving the sealing member provided at the inversion body 40 is formed in a tapered shape. In the embodiment, the stamp surface of the print body 41 is circular and the O-ring 43 suitable for the diameter of the print body is used for the inversion body 40. Then, the sealed surface 51*a* receiving the O-ring 43 is formed as an inclined surface which decreases in diameter as it goes toward a center. When the sealed surface is formed as the inclined surface in this way, a force (a force acting on the wedge) which is larger than that of a flat surface contact is exhibited and thus the air-tightness inside the ink cartridge 50 can be enhanced. Since it is not necessary to strengthen the repelling force of the coil spring 60, a pressing force at the time of imprinting can be made smaller than before and the operability can be enhanced.

Figure 6:
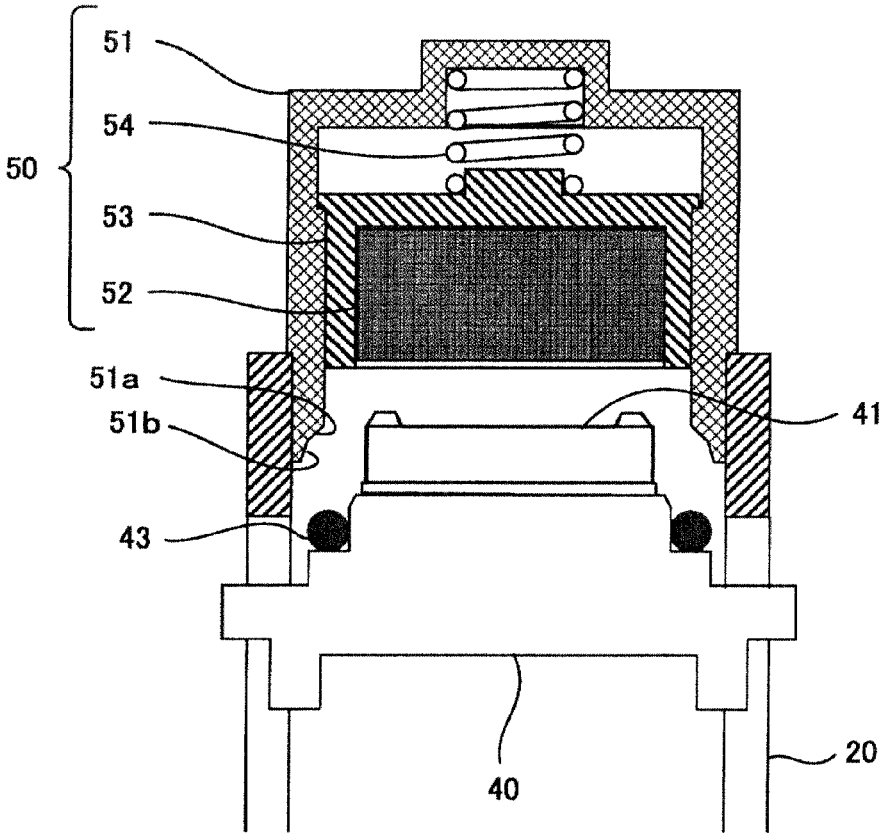
FIG. 6 is a diagram illustrating a structure of an ink cartridge according to the other embodiment.

Further, as exemplified in the other embodiment of FIG. 6, the sealed surface of the end inner wall of the ink cartridge 50 may include a second inclined surface 51*b* which is formed at the outside of the first inclined surface 51*a* to have an inclination angle different from that of the first inclined surface. When the sealed surface is formed as multiple surfaces and the sealing member contacts at two or more points in this way, it is possible to prevent a positional deviation of the inversion body 40 and to obtain a uniform transfer load of the print body 41 with respect to the ink pad 52.

The operation of the reverse type stamp 10 with the above-described configuration will be described with reference to FIG. 7.

In a non-use state in which the outer cylindrical body 30 of the stamp 10 is not pressed, the outer cylindrical body 30 and the inner cylindrical body 20 are most distant from each other. At this time, the stamp surface of the print body 41 contacts the ink pad 52 so that ink is transferred thereto. Further, the inside of the ink cartridge 50 is sealed through the O-ring 43 of the inversion body 40 urged by the coil spring 60.

The reverse type stamp 10 performs an imprinting operation by allowing the lower end of the inner cylindrical body 20 to contact a paper surface P. When the outer cylindrical body 30 is pressed down against the repelling force of the coil spring 60 while the stamp 10 stands on the paper surface P, the inner cylindrical body 20 is retracted as a whole in order to enter the outer cylindrical body 30. At this time, even in the inversion body 40 pivoted by the inner wall portion of the outer cylindrical body 30, the horizontal shaft 42 is also guided by the slit aperture 20*a* of the inner cylindrical body 20 to be moved downward inside the inner cylindrical body 20.

Figure 7:
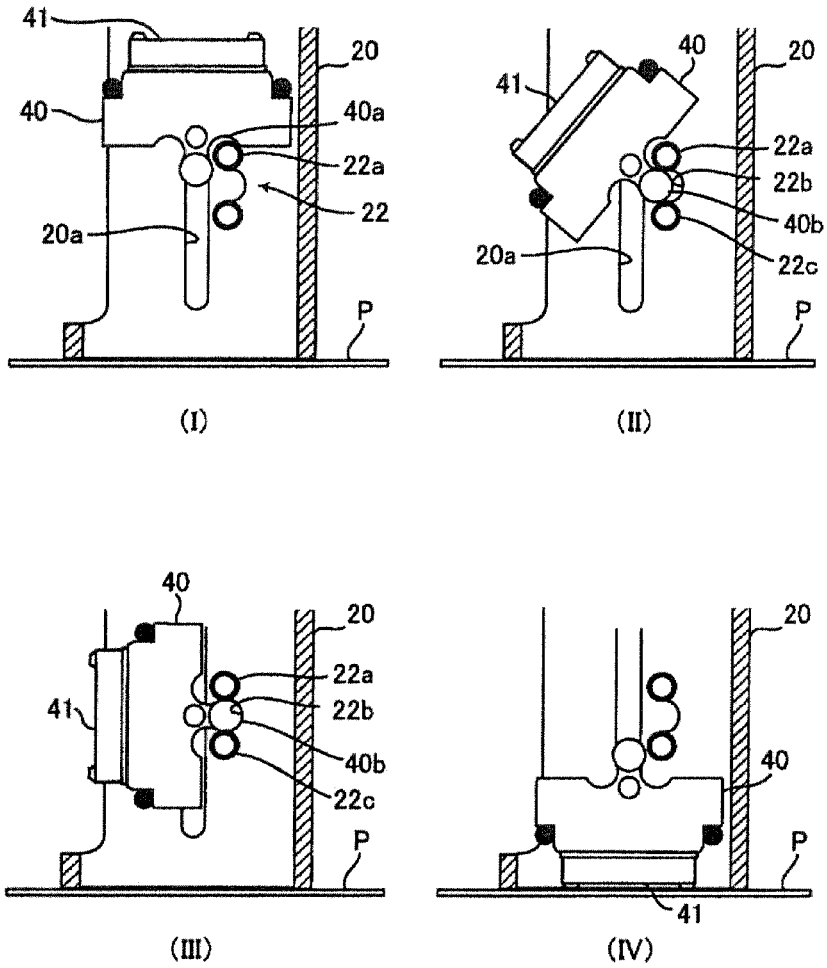
FIG. 7 is a flowchart illustrating a marking operation of the reverse type stamp.

When the inversion body 40 of the print body 41 moves down in synchronization with the pressing operation of the outer cylindrical body 30, a first semi-circular groove 40*a* formed at the rear lower end of the inversion body 40 first contacts the upper small protrusion 22*a* of the inner cylindrical body 20 (FIG. 7(I)). At this time, the rear side of the inversion body 40 is pressed up by the upper small protrusion 22*a* in accordance with the downward movement of the inversion body 40 so that the inversion body 40 starts to rotate about the horizontal shaft 42 (FIG. 7(II)). When a rotation angle of the inversion body 40 becomes 90°, a center semi-circular protrusion 40*b* engages with the inversion guide 22 to enter the intermediate groove 22*b* (FIG. 7(III)). When the inversion body 40 is further rotated, the lower small protrusion 22*c* presses the semi-circular protrusion 40*b* up. Accordingly, the inversion body 40 is finally reversed by 180° at the lower end position of the inner cylindrical body 20 so that the stamp surface (the print body 41) faces downward (FIG. 7(IV)). If a pressing force is applied to the outer cylindrical body 30 while the print body 41 contacts the paper surface P, the ink of the print body 41 is transferred onto the paper surface P for the imprinting operation.

When the outer cylindrical body 30 is not pressed after the imprinting operation is completed, the inner cylindrical body 20 returns to an initial position by the repelling force of the compressed coil spring 60. Accordingly, the inversion body 40 moves inside the inner cylindrical body 20 to return to an initial position, but the stamp surface is reversed upward in the opposite manner to the engagement operation with respect to the inversion guide 22.

According to the reverse type stamp 10, the ink pad 52 is accommodated in the movable container 53 slidable inside the ink cartridge 50 fitted to the inner cylindrical body 20 and the inversion body 40 is pressed against the ink pad 52 by the repelling force of the coil spring 54 corresponding to the urging means. In the embodiment, since the ink pad 52 is elastically supported by the cartridge 50 through the coil spring 54 having a spring constant smaller than that of the ink pad 52, a transfer load of the print body 41 with respect to the ink pad 52 is reduced. Accordingly, for example, even when the ink pad 52 of which the fiber density of the surface layer side is relatively hard is adopted, it is possible to prevent a deformation such as sagging in the ink pad 52. Further, since the ink pad 52 is elastically supported by the coil spring 54, an ink transfer load with respect to the print body 41 is not unnecessarily large and can be appropriately adjusted. In this way, it is possible to prevent bleeding, staining, and the like of the seal imprint by maintaining the flatness of the ink pad 52 and adjusting the transfer load in accordance with a dimensional change of a molded article (a stamp surface, etc.).

Further, the reverse type stamp 10 has a structure in which an accommodation space of the ink pad is blocked by the print body 41 and the body 40 is pressed against the end of the outer frame case 51 of the ink cartridge 50 through a packing (for example, a sealing member like the O-ring 43) disposed in the periphery of the print body 41. Accordingly, when the stamp 10 is not in use, the air-tightness in the space for accommodating the ink pad 52 is secured, and even when the quick-drying ink is used, volatilization and drying of the ink can be effectively prevented.

Further, according to the reverse type stamp 10, the sealed surface 51*a* of the end inner wall receiving the O-ring 43 corresponding to the sealing member of the inversion body 40 in the ink cartridge 50 is formed in a tapered shape. Thus, a force (a force acting on the wedge) which is larger than that of a flat surface contact is exhibited and the O-ring 43 comes into press-contact with the sealed surface 51*a* so as to be bitten therein. For this reason, the air-tightness of the ink cartridge 50 can be realized by a force smaller than that of the conventional configuration in which the sealing member is received by the flat surface. Therefore, the air-tightness of the ink pad can be ensured and a large urging force for improving the sealability of the ink cartridge 50 is not needed. For this reason, a pressing force (a force against the urging force of the coil spring 60) for the imprinting operation can be reduced compared to the related art.

What is claimed is:

1. A reverse type stamp comprising:

an outer cylindrical body;

an inner cylindrical body which is accommodated in the outer cylindrical body and configured to be able to perform a relative movement thereto;

an elastic member which constantly urges the inner cylindrical body in a protruding direction inside the outer cylindrical body;

an inversion body which is accommodated in the inner cylindrical body and configured to be able to be reversed and returned in synchronization with said relative movement; and a print body which is joined to the inversion body, wherein the inner cylindrical body slidably accommodates a movable container with an ink pad, and the movable container is elastically supported by an urging means, which applies an elastic force to a surface of the movable container opposite to a stamp surface of the print body.

2. The reverse type stamp according to claim 1, wherein the movable container is accommodated inside an accommodation space of the inner cylindrical body, the accommodation space is blocked by the print body using a repelling force of the elastic member, and a sealing member is provided for air-tightness of the accommodation space blocked by the print body.

3. The reverse type stamp according to claim 2, wherein the sealing member is an O-ring which surrounds an outer peripheral portion of the print body.

4. The reverse type stamp according to claim 1, wherein an elastic modulus of the urging means is set to be smaller than that of the ink pad.

5. The reverse type stamp according to claim 1, wherein the urging means is a coil spring which is provided at a rear surface of the movable container.

6. A reverse type stamp comprising:

an outer cylindrical body;

an inner cylindrical body which is accommodated in the outer cylindrical body and configured to be able to perform a relative movement thereto;

an elastic member which constantly urges the inner cylindrical body in a protruding direction inside the outer cylindrical body;

an inversion body which is accommodated in the inner cylindrical body and configured to be able to be reversed and returned in synchronization with said relative movement; and a print body which is joined to the inversion body, wherein the inner cylindrical body has an ink cartridge therein, and wherein an inner portion of the ink cartridge is sealed by a sealing member provided at the inversion body and a sealed surface of the ink cartridge receiving the sealing member is formed in a tapered shape.

7. The reverse type stamp according to claim 6, wherein the sealing member is an O-ring suitable for the print body and the sealed surface is formed as an inclined surface which decreases in diameter as it goes toward a center.

8. The reverse type stamp according to claim 7, wherein the sealed surface is provided with a second inclined surface which is formed at the outside of a first inclined surface to have an inclination angle different from that of the first inclined surface.

* * * * *